US011297929B2

(12) United States Patent
Zarom et al.

(10) Patent No.: US 11,297,929 B2
(45) Date of Patent: Apr. 12, 2022

(54) DEVICE FOR HANDS-FREE HANGING A HAND-OPERATED TOOL

(71) Applicants: Itai Zarom, New York, NY (US); Guy Levy, Raanana (IL)

(72) Inventors: Itai Zarom, New York, NY (US); Guy Levy, Raanana (IL)

( * ) Notice: Subject to any disclaimer, the term of this patent is extended or adjusted under 35 U.S.C. 154(b) by 0 days.

(21) Appl. No.: 17/268,920

(22) PCT Filed: Aug. 21, 2019

(86) PCT No.: PCT/IL2019/050936
§ 371 (c)(1),
(2) Date: Feb. 16, 2021

(87) PCT Pub. No.: WO2020/039437
PCT Pub. Date: Feb. 27, 2020

(65) Prior Publication Data

US 2021/0244167 A1 Aug. 12, 2021

Related U.S. Application Data

(60) Provisional application No. 62/720,930, filed on Aug. 22, 2018.

(51) Int. Cl.
*A45F 5/00* (2006.01)
*A45F 5/02* (2006.01)

(52) U.S. Cl.
CPC ..... *A45F 5/004* (2013.01); *A45F 5/02* (2013.01); *A45F 2200/0575* (2013.01)

(58) Field of Classification Search
CPC ..... A45F 5/044
(Continued)

(56) References Cited

U.S. PATENT DOCUMENTS 3,041,044 A * 6/1962 Nixon ..... B65H 75/38 242/381
3,904,843 A * 9/1975 Kendechy ..... H01H 3/16 200/332
(Continued)

FOREIGN PATENT DOCUMENTS

BR 102013020123 A2 3/2016
CA 2982328 A1 10/2016
(Continued)

OTHER PUBLICATIONS

PCT Search Report for International application No. PCT/IL2019/050936 dated Oct. 30, 2019, 6 pp.
(Continued)

*Primary Examiner* — Nathan J Newhouse
*Assistant Examiner* — Lester L Vanterpool
(74) *Attorney, Agent, or Firm* — The Roy Gross Law Firm, LLC; Roy Gross

(57) ABSTRACT

A device for hands-free hanging a hand-operated tool is attachable to a garment. The aforesaid device comprises: (a) a drum retractor having a rotatable reel loaded by a spring; (b) a cable having a first terminal secured to said reel and a second terminal connectable to said hand-operated tool; said cable is at least partially coiled on the rotatable reel. The cable is provided an arresting arrangement comprising a retaining member secured to the cable in cooperation with a quickly openable gate having an open position and a closed position such that the cable carrying the retaining member is uncoilable from the reel in the open position and blocked from uncoiling in the closed position.

4 Claims, 11 Drawing Sheets

(58) Field of Classification Search
USPC ..... 224/162
See application file for complete search history.

(56) References Cited

U.S. PATENT DOCUMENTS 4,350,850 A * 9/1982 Kovacik ..... H02G 11/02 191/12.2 R
5,645,147 A * 7/1997 Kovacik ..... H02G 11/02 191/12.2 R
5,833,165 A * 11/1998 Paugh ..... A45F 5/004 242/379.2
5,954,288 A * 9/1999 Shih ..... A45F 5/004 242/380
6,152,392 A * 11/2000 Hawkins ..... B60R 11/02 242/379
6,290,158 B1 * 9/2001 Huang ..... G01B 3/11 242/379
6,918,669 B1 7/2005 Tamborrino
7,665,684 B2 * 2/2010 Salentine ..... A45F 5/004 242/379.2
7,802,746 B2 * 9/2010 Ito ..... H04R 1/1033 242/379
8,191,815 B2 * 6/2012 Huang ..... B65H 75/48 242/379
8,662,464 B2 * 3/2014 Hand ..... G09F 7/18 248/329
8,678,255 B2 * 3/2014 Zhang ..... B65H 75/4434 224/162
2003/0089141 A1 5/2003 Edwards et al.
2005/0011982 A1 * 1/2005 Salentine ..... A45F 5/004 242/379.2
2005/0051406 A1 3/2005 Hopper
2005/0072819 A1 * 4/2005 Maldonado ..... A45F 5/021 224/162
2005/0281021 A1 * 12/2005 Thompson ..... F21V 21/18 362/157
2008/0265082 A1 * 10/2008 Angiuli ..... A45F 5/004 242/400
2009/0266861 A1 * 10/2009 Helmer ..... A45F 5/04 224/584
2012/0074276 A1 * 3/2012 Hand ..... G09F 7/18 248/205.6
2013/0181019 A1 * 7/2013 Salentine ..... A45F 5/021 224/242
2014/0000533 A1 * 1/2014 Limberis ..... A01K 27/006 119/796
2015/0168097 A1 6/2015 Echevarria
2015/0223588 A1 * 8/2015 DeNittis ..... A44C 3/001 24/298
2017/0146316 A1 5/2017 Willard

FOREIGN PATENT DOCUMENTS

CN 204935604 U 1/2016
WO 2012094544 A2 7/2012

OTHER PUBLICATIONS

PCT Written Opinion for International application No. PCT/IL2019/050936 dated Oct. 30, 2019, 5 pp.

* cited by examiner

DEVICE FOR HANDS-FREE HANGING A HAND-OPERATED TOOL

This application is a National Phase of PCT Patent Application No. PCT/IL2019/050936 having International filing date of Aug. 21, 2019, which claims the benefit of priority of U.S. Provisional Patent Application No. 62/720,930, filed Aug. 22, 2018, the contents of which are all incorporated herein by reference in their entirety.

FIELD OF THE INVENTION

The present invention relates to hands-free hangers and, more particularly, to a spring-loaded retracting device.

BACKGROUND OF THE INVENTION

Those who work with their hands often have more tools to work with than hands to hold them. When hands are full, picking up one tool requires that another be put down. Often, an individual will set the tool on a nearby table top, or, depending upon the type of tool, place it in a pocket or attach it to an article of clothing.

Typically, during the course of performing the task, the need arises to use a tool that has been set down. However, the individual often does not immediately remember where he set the tool or finds that she has moved away from easy reach of the tool and must now stretch, turn, bend, or move back to reach it.

US20150168097 discloses methods, systems, and apparatus provide multiple-position slings and hands-free carrying devices for any equipment. Systems include adjustably attaching into a garment, a single-point sling with a slider strap and slider for repositioning a detachable lanyard.

The technical solutions known in the art disclose devices with a detented position of a hanging cable or a sling which cannot be changed quickly. There is a long-felt and unmet need for a device for hands-free hanging a hand-operated tool attachable to a garment, for example, a tool vest providing an opportunity of quickly uncoiling and coiling a hanging cable carrying a hand-operated tool.

SUMMARY OF THE INVENTION

It is hence one object of the invention to disclose a device for hands-free hanging a hand-operated tool attachable to a garment, for example, a tool vest. The aforesaid device comprises: (a) a drum retractor having a rotatable reel loaded by a spring; (b) a cable having a first terminal secured to the reel and a second terminal connectable to the hand-operated tool; the cable is at least partially coiled on the rotatable reel.

It is a core purpose of the invention to provide the cable provided an arresting arrangement comprising a retaining member secured to the cable in cooperation with a quickly openable gate having an open position and a closed position such that the cable carrying the retaining member is uncoilable from the reel in the open position and blocked from uncoiling in the closed position.

Another object of the invention is to disclose the retaining member which is a metallic ball.

A further object of the invention is to disclose a position of the retaining member which is adjustable along the cable.

A further object of the invention is to disclose the gate comprising at least one rotatable stopper preventing the retaining member from passing through the gate.

A further object of the invention is to disclose the second terminal of the cable provided with a connector configured for connecting the hand-operated tool.

A further object of the invention is to disclose the device comprising a source of light.

A further object of the invention is to disclose the source of light selected from the group consisting of a flash lamp, a laser, a LED and any combination thereof.

A further object of the invention is to disclose a method of hands-free hanging a hand-operated tool. The aforesaid method comprises steps of: (a) providing a device comprising: (i) a drum retractor having a rotatable reel loaded by a spring; (ii) a cable having a first terminal secured to the reel and a second terminal connectable to the hand-operated tool; the cable is at least partially coiled on the rotatable reel; the cable is provided an arresting arrangement comprising a retaining member secured to the cable in cooperation with a quickly openable gate having an open position and a closed position such that the cable carrying the retaining member is uncoilable from the reel in the open position and blocked from uncoiling in the closed position; (b) providing a garment suitable to a user to be put on; (c) putting the garment on; (d) attaching the device to the garment; (e) connecting the second terminal to the hand-operated tool; (f) coiling and uncoiling the cable in the first position of the gate; and (g) blocking the cable from uncoiling in the closed position.

BRIEF DESCRIPTION OF THE DRAWINGS

In order to understand the invention and to see how it may be implemented in practice, a plurality of embodiments is adapted to now be described, by way of non-limiting example only, with reference to the accompanying drawings, in which.

DETAILED DESCRIPTION OF THE INVENTION

The following description is provided, so as to enable any person skilled in the art to make use of said invention and sets forth the best modes contemplated by the inventor of carrying out this invention. Various modifications, however, are adapted to remain apparent to those skilled in the art, since the generic principles of the present invention have been defined specifically to provide a device for hands-free hanging a hand-operated tool attachable to a garment and a method of doing the same.

Figure 1A:
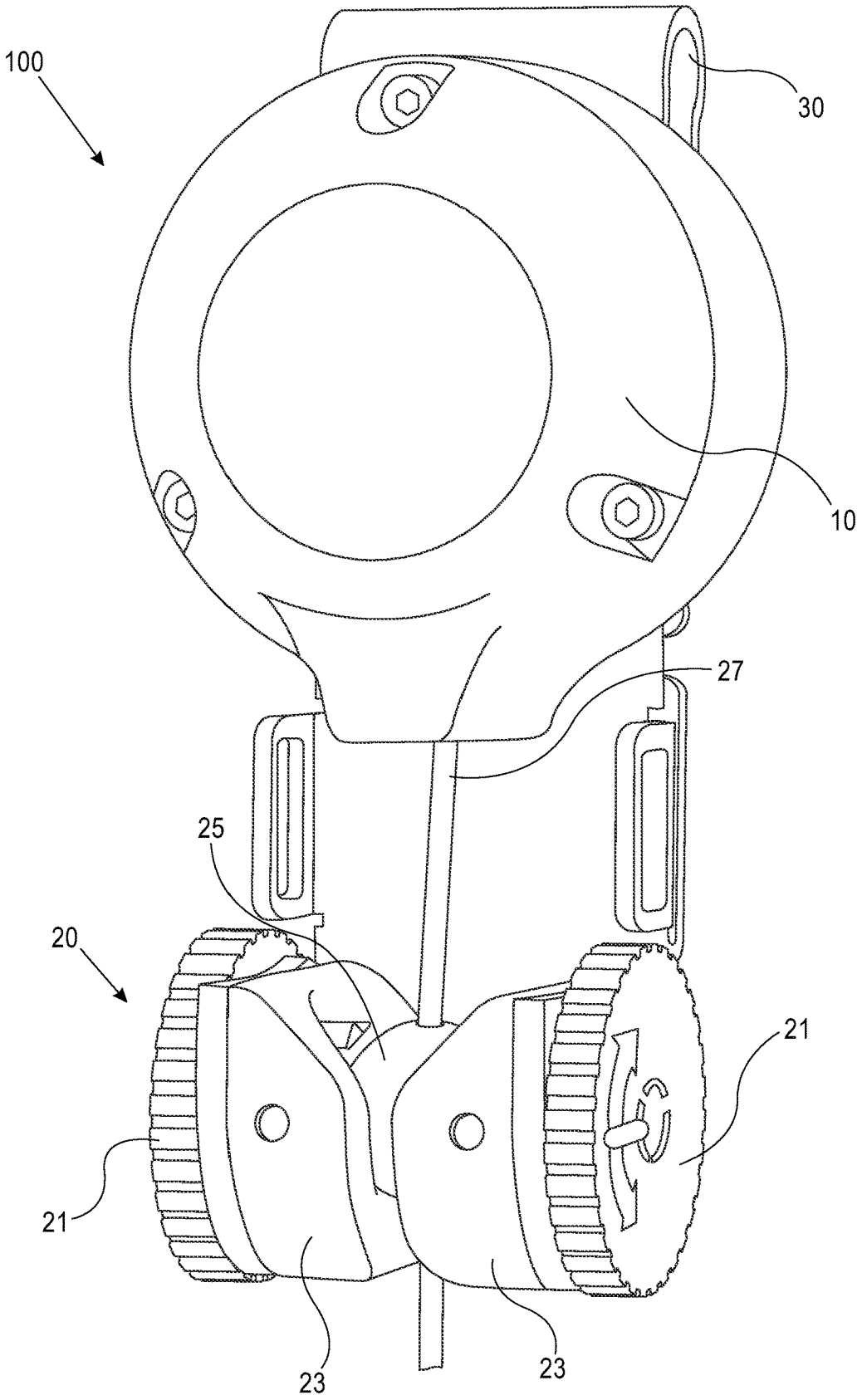
FIGS. 1*a* and 1*b* are general front and back perspective views of a first embodiment of a device for hands-free hanging a hand-operated tool attachable to a garment, respectively.
Figure 1B:
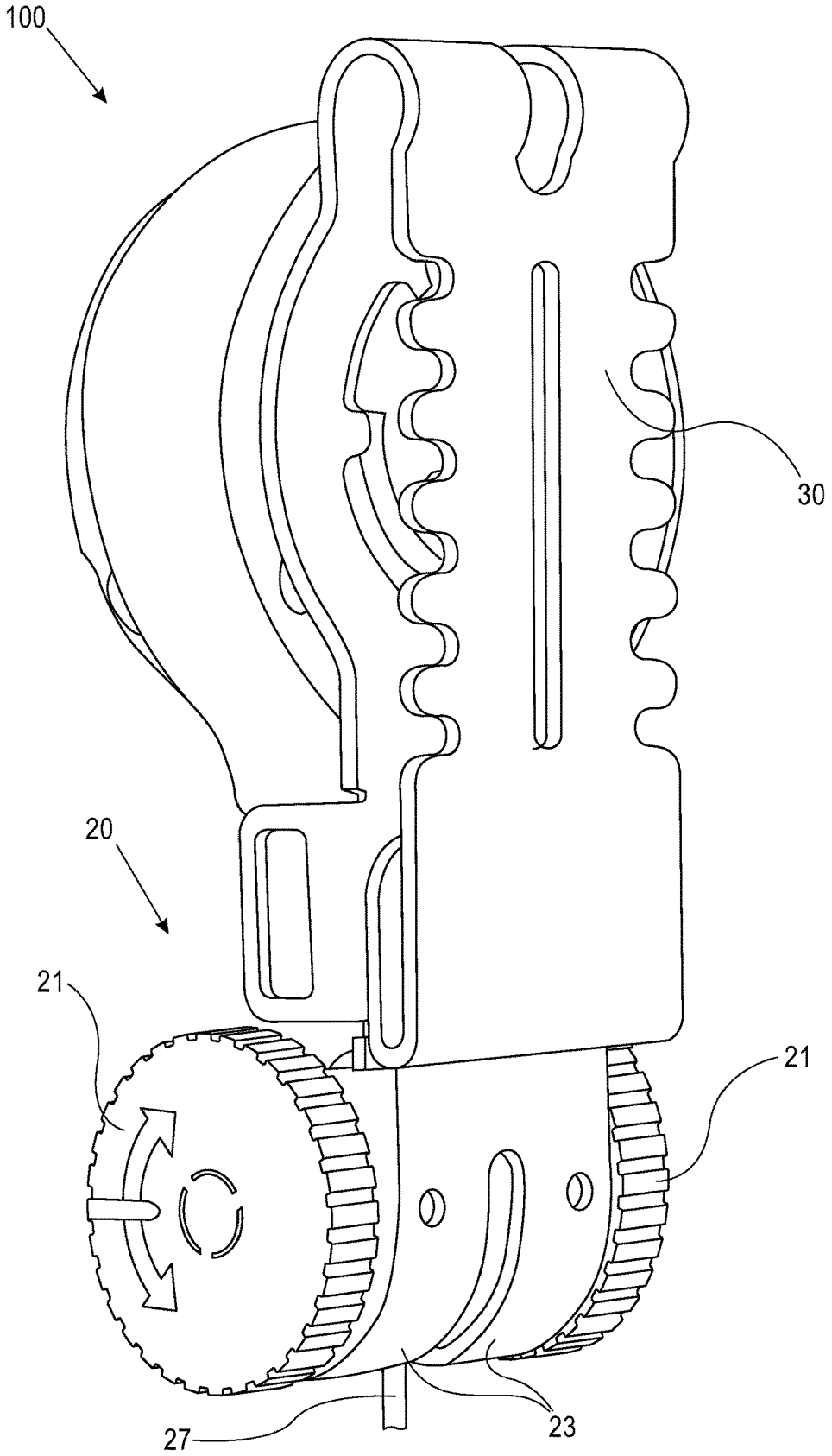

Reference is now made to FIGS. 1*a* and 1*b* presenting a first embodiment of the present invention which is device 100 for hands-free hanging a hand-operated tool attachable to a garment. The aforesaid device comprises drum retractor 10 having a rotatable reel loaded by a spring (not shown) and cable 27 secured to the reel. Cable 27 is connectable to a hand-operated tool (not shown). Cable 27 is at least partially coiled on the rotatable reel. Numeral 30 refers to a clip designed for securing device 100 to a garment (e.g. tool vest).

Arresting arrangement 20 comprises a retaining member 25 secured to cable 27 being in cooperation with a quickly openable gate formed by lips 23 and rotatable handles 21. The quickly openable gate has an open position and a closed position such that cable 27 carrying retaining member 25 is uncoilable from the reel in the open position and blocked from uncoiling in the closed position.

Figure 2:
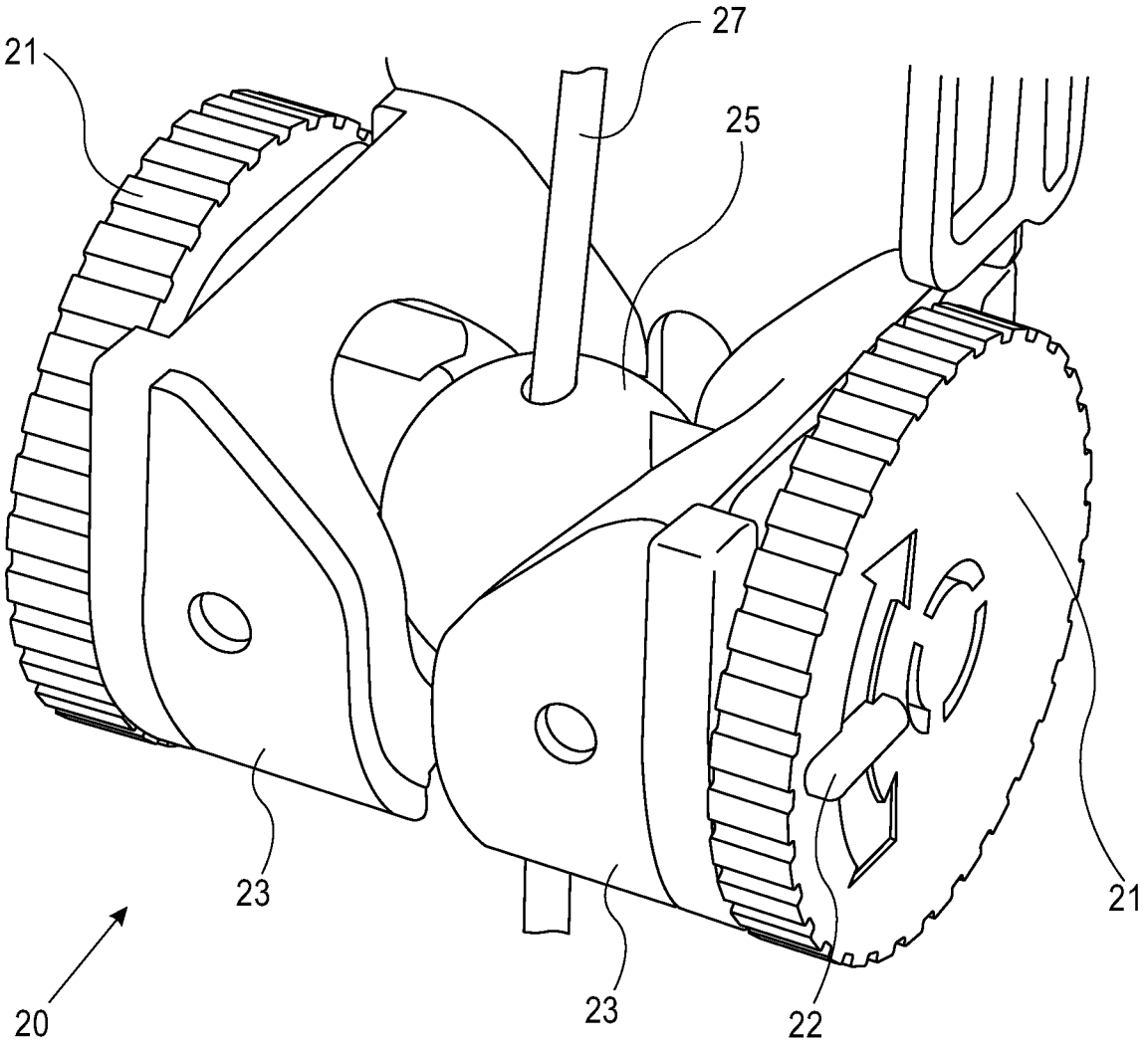
FIG. 2 is an enlarged perspective view of a first embodiment of an arresting arrangement.

Reference is now made to FIG. 2 presenting an enlarged perspective view of arresting arrangement 20. Rotatable handles 21 have open and closed positions which allows uncoiling cable 27 from the reel (no shown) and blocks passing retaining member 25 via lips 23, respectively. Numeral 22 refers to an indicating slider showing the instant status of arresting arrangement 20. Position of retaining member 25 on cable 27 is adjustable because retaining member 25 is easily detachable from cable 27 and securable thereto.

Figure 3A:
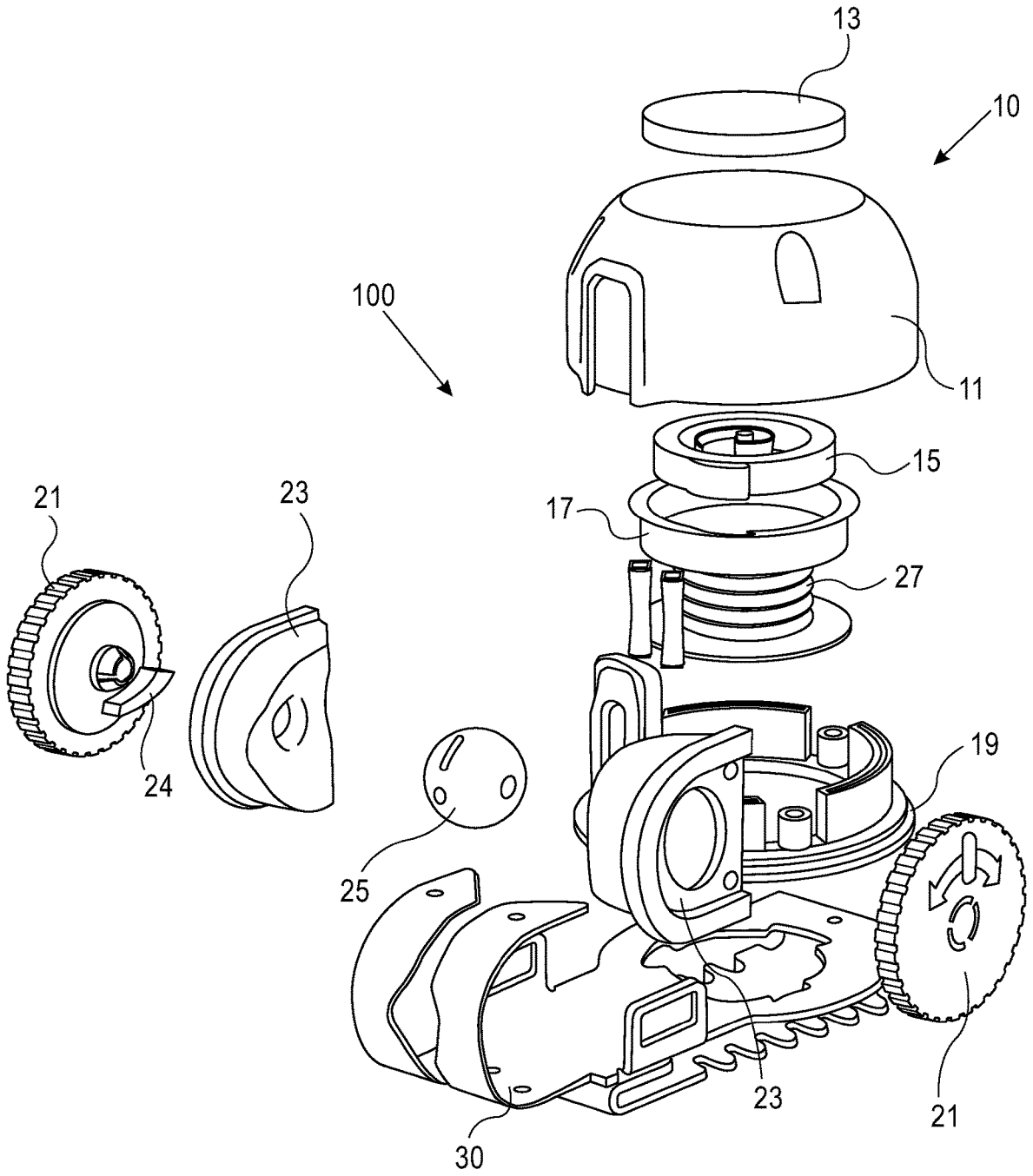
FIGS. 3*a* and 3*b* are horizontally and vertically presented exploded views of a first embodiment of a device for hands-free hanging a hand-operated tool attachable to a garment, respectively.
Figure 3B:
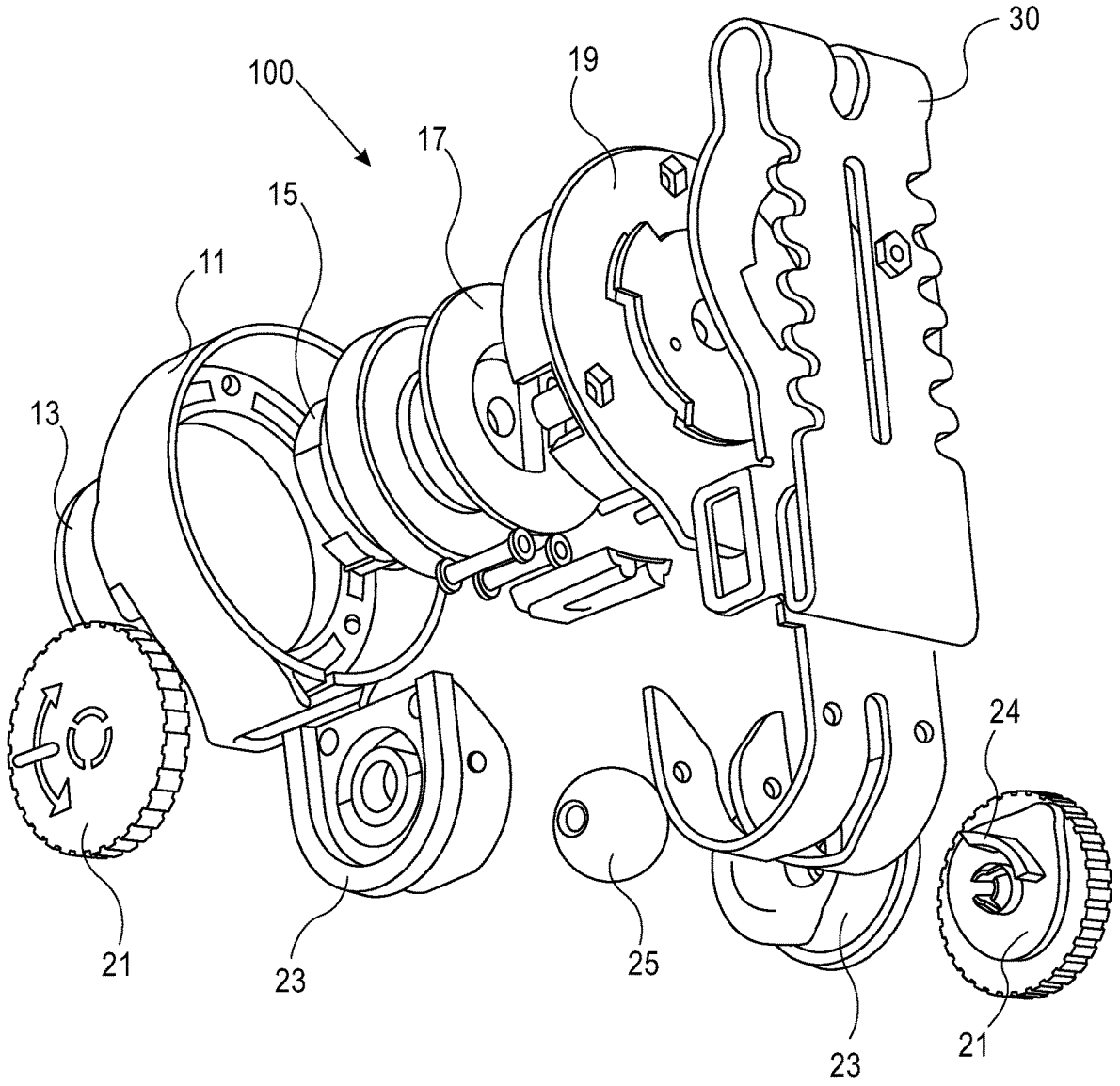
Figure 4A:
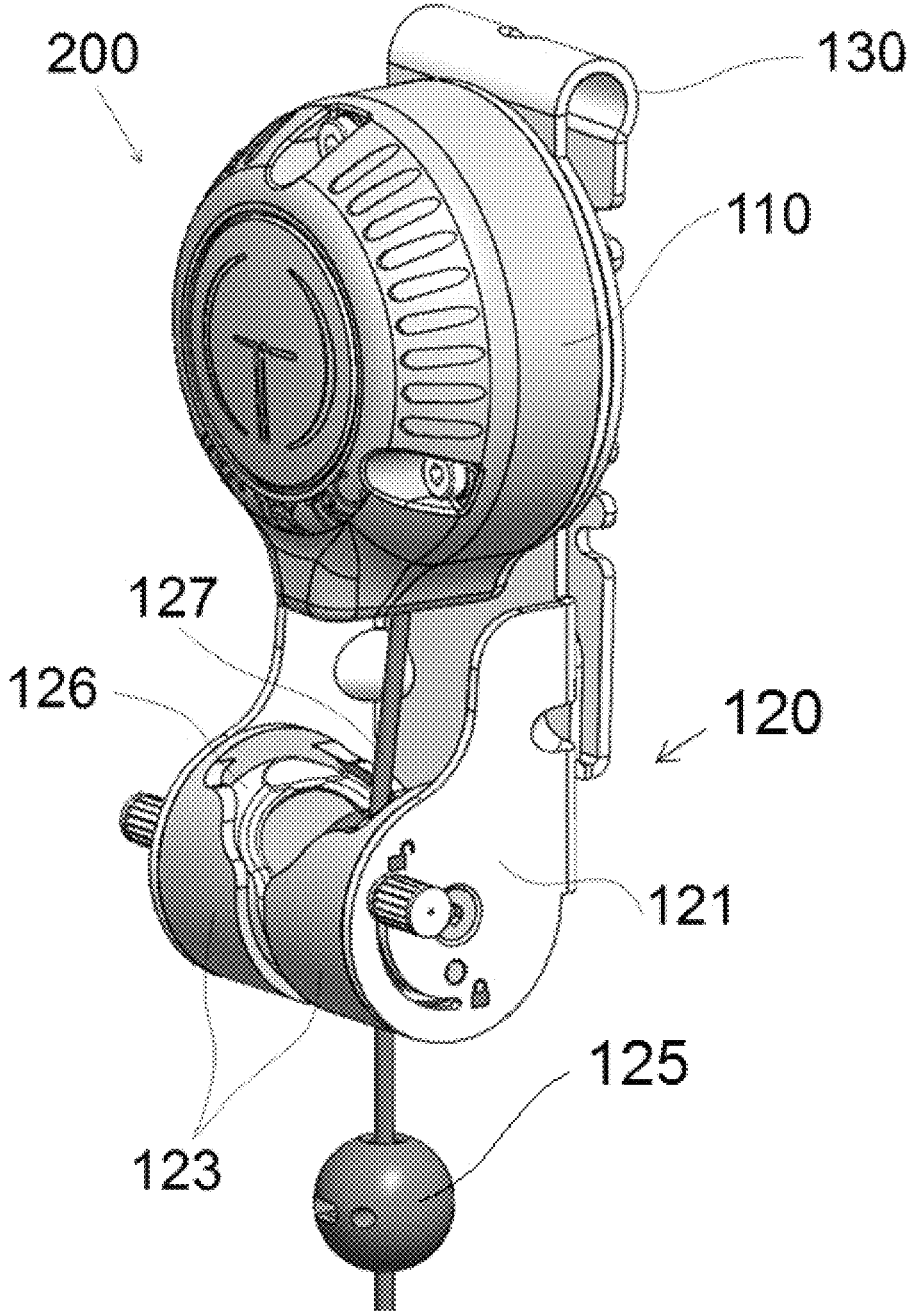
FIGS. 4*a* and 4*b* are perspective views of a second embodiment of a device for hands free hanging a hand-operated tool attachable to a garment in open and closed positions, respectively.
Figure 4B:
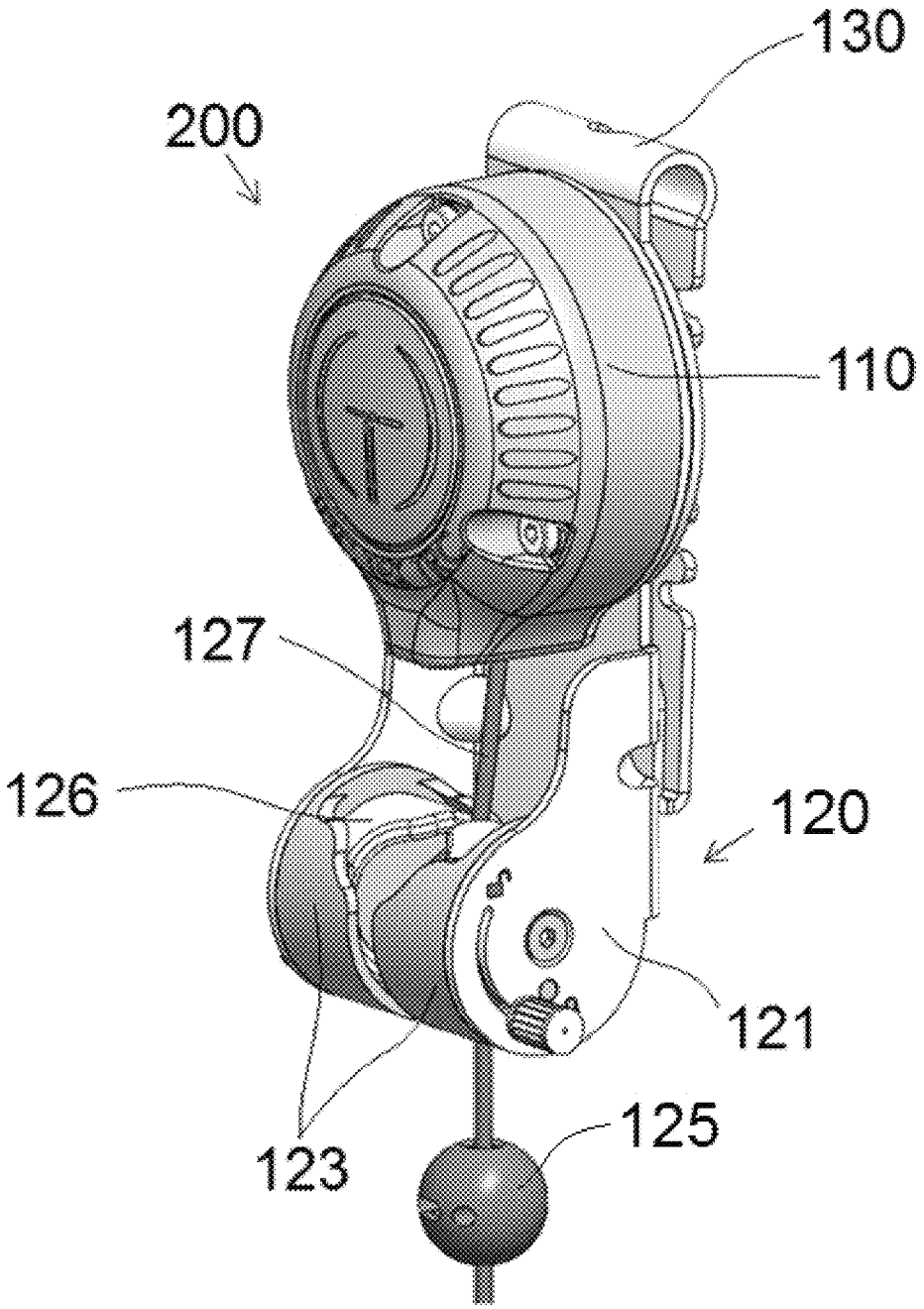
Figure 5A:
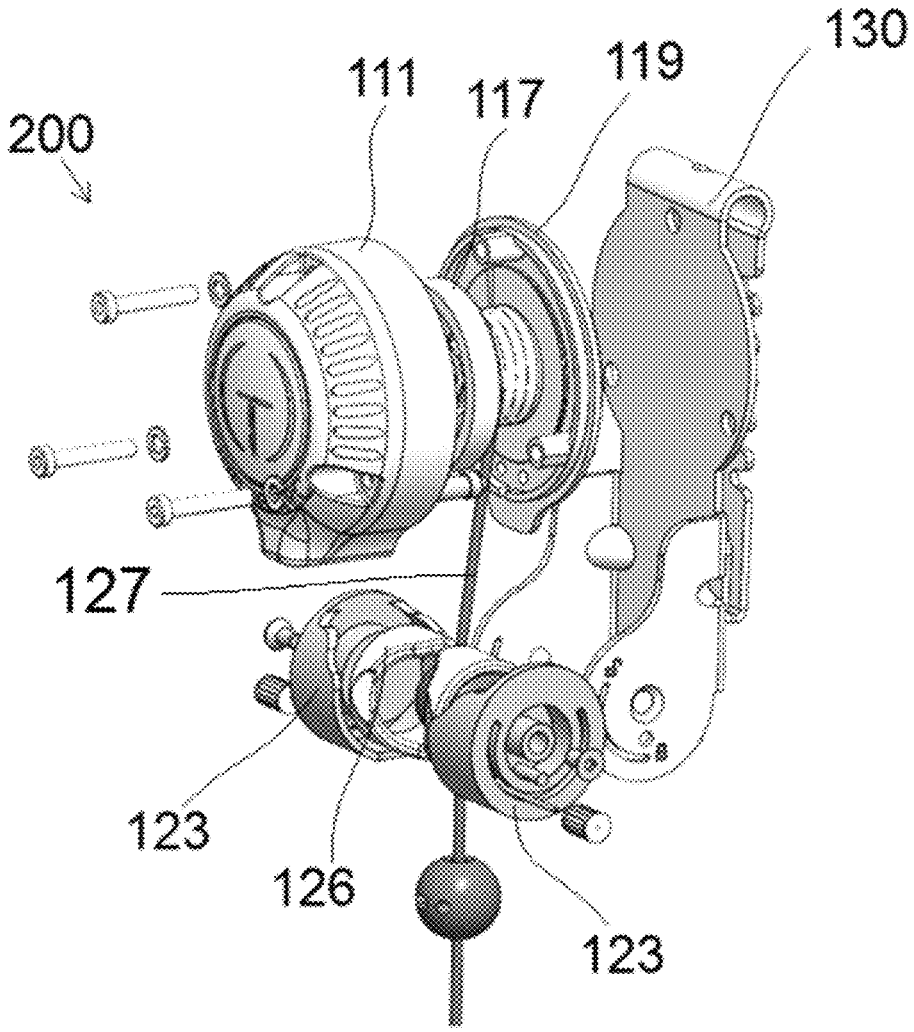
FIGS. 5*a* and 5*b* are front and back perspective exploded views of a second embodiment of a device for hands-free hanging a hand-operated tool attachable to a garment, respectively.
Figure 5B:
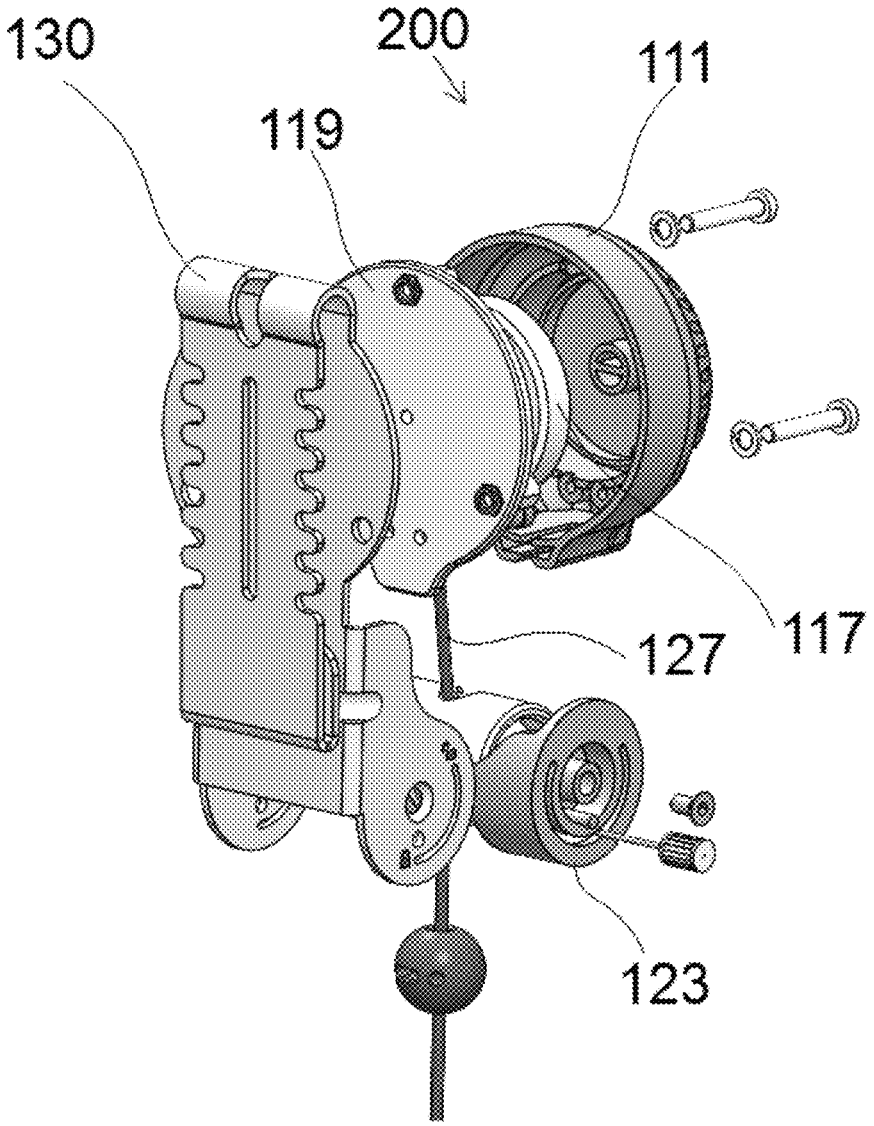

Reference is now made to FIGS. 3*a* and 3*b* presenting horizontally and vertically presented exploded views of a device for hands-free hanging a hand-operated tool attachable to a garment, respectively. Drum retractor 10 comprises reel 17 with cable 27 secured thereto and at least partially coiled thereon. Reel 17 is loaded by spring 15 and designed to withdraw unloaded cable 27 (without a hand-operated tool connected to the cable). Reel 17 and spring 15 are accommodated between housing 19 and cover member 11. Rotatable members 21 have projections 24 designed for blocking retaining member 25 within lips 23 and preventing cable 27 from uncoiling. Referring to FIGS. 4(*a,b*) and 5(*a,b*), cable 127 is windable within drum retractor 110. Reel 117 is disposed in housing 119 and covered by cover member 111. Cable 127 is provided with retaining member 125 is blockable within arresting arrangement 120. The aforesaid arresting arrangement 120 comprises two rotatable lips 123 and cylindrical arrester 126.

Figure 6:
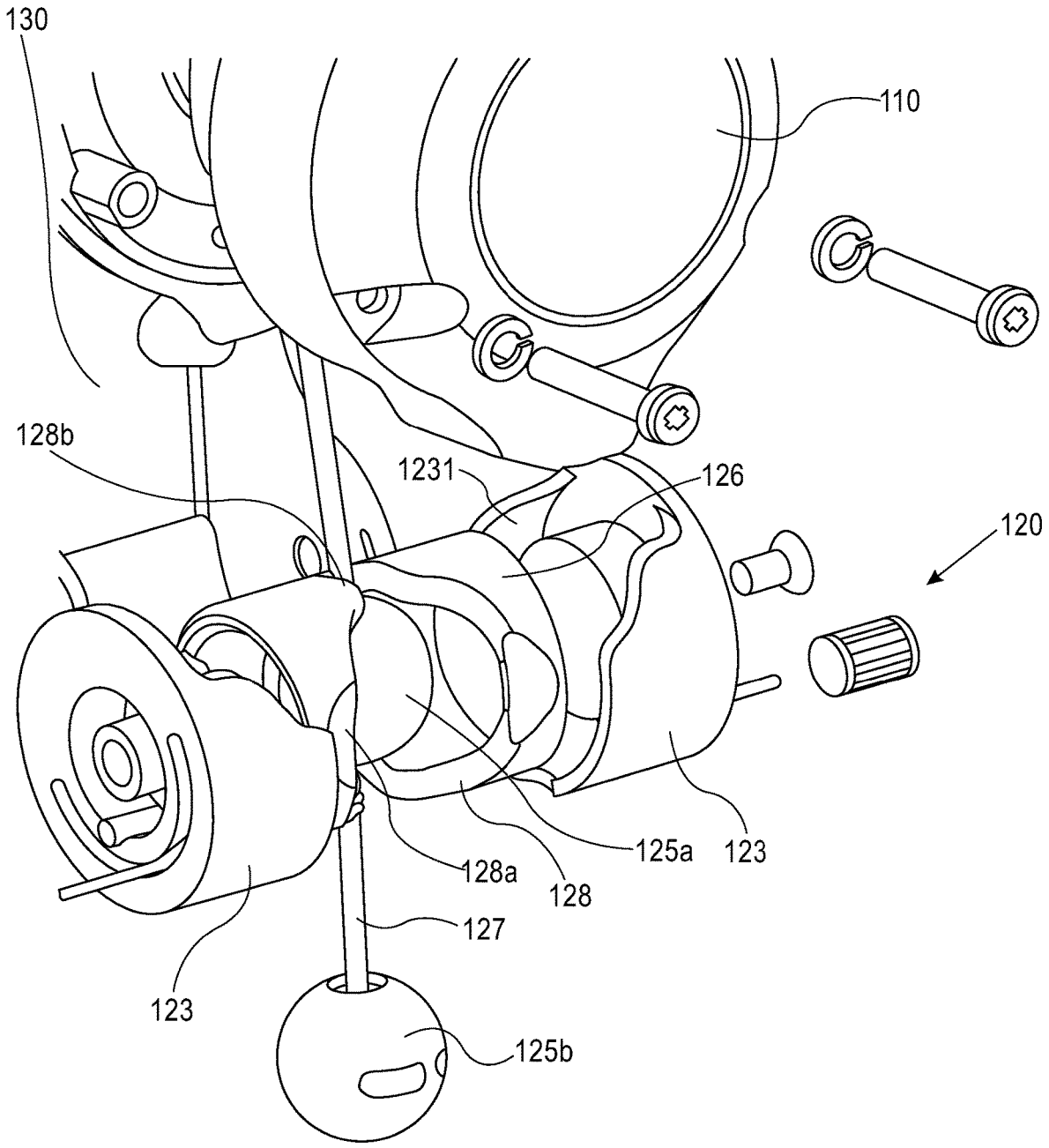
FIG. 6 is an enlarged perspective view of a second embodiment of an arresting arrangement.
Figure 7A:
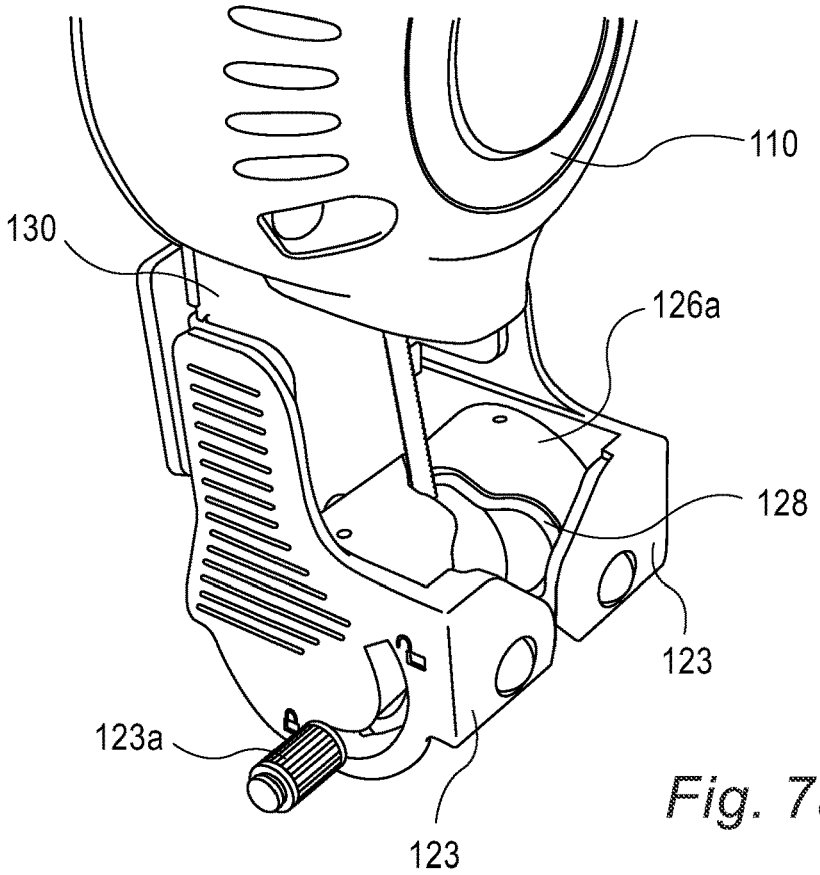
FIGS. 7*a* and 7*b* are enlarged perspective views of a second embodiment of an arresting arrangement in closed and open positions, respectively.
Figure 7B:
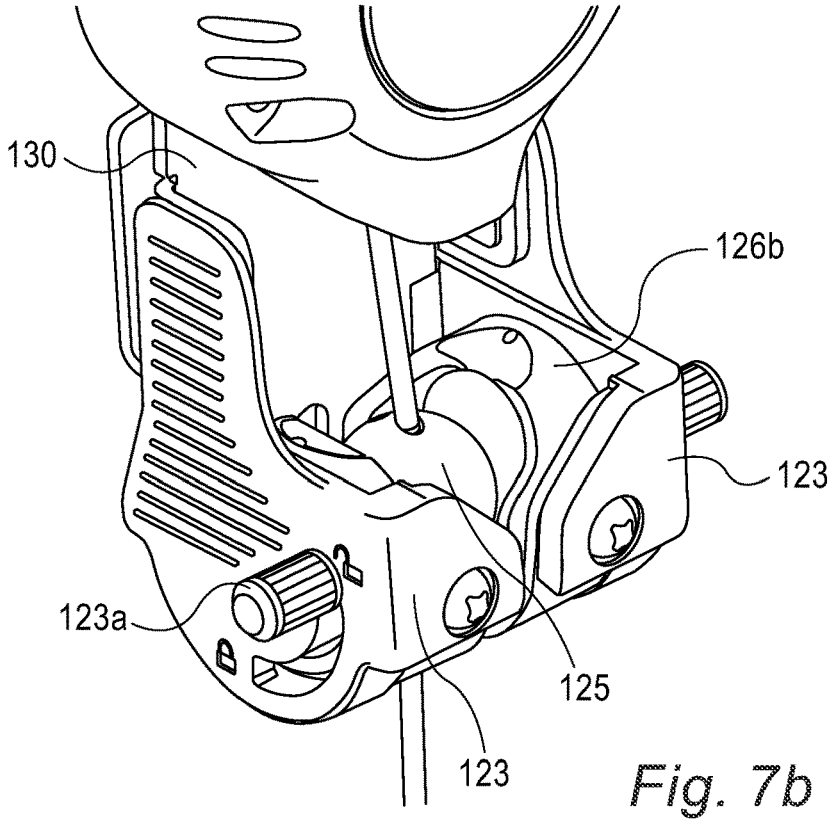

Reference is now made to FIG. 6 presenting an enlarged perspective view of a second embodiment of arresting arrangement 120. Rotatable lips 123 are cooperatively interconnected by cylindrical arrester 126. Specifically, terminals of cylindrical arrester 126 are inserted into annular slot 1231. Cylindrical arrester 126 is rotatable around its longitudinal axis. Cylindrical arrester has side circumferentially-arranged recess 128 of variable width. Circumferentially-arranged recess has wider portion 128*a* configured for passing retaining member 125 therethrough in the open position and narrower portion 128*b* configured for blocking retaining member 125 and passing cable 127 therethrough in the closed position. Numerals 125*a* and 125*b* refer to a retaining member blocked in and released from an cylindrical arrester 126. Reference is now made to FIGS. 7*a* and 7*b*, presenting enlarged perspective views of a second embodiment of an arresting arrangement in closed and open positions, respectively. Numeral 126*a* refers to the cylinder arrester in the closed position while numeral 126*b* refers to the cylinder arrester in the open position.

According to the present invention, a device for hands-free hanging a hand-operated tool is attachable to a garment, for example, a tool vest. The aforesaid device comprises: (a) a drum retractor having a rotatable reel loaded by a spring; (b) a cable having a first terminal secured to the reel and a second terminal connectable to the hand-operated tool; the cable is at least partially coiled on the rotatable reel.

It is a core feature of the invention to provide the cable provided an arresting arrangement comprising a retaining member secured to the cable in cooperation with a quickly openable gate having an open position and a closed position such that the cable carrying the retaining member is uncoilable from the reel in the open position and blocked from uncoiling in the closed position.

According to one embodiment of the present invention, the retaining member is a metallic ball.

According to a further embodiment of the present invention, a position of the retaining member is adjustable along the cable.

According to a further embodiment of the present invention, the gate comprises at least one rotatable stopper preventing the retaining member from passing through the gate.

According to a further embodiment of the present invention, the second terminal of the cable is provided with a connector configured for connecting the hand-operated tool.

According to a further embodiment of the present invention, the device comprises a source of light.

According to a further embodiment of the present invention, the source of light is selected from the group consisting of a flash lamp, a laser, a LED and any combination thereof.

According to a further embodiment of the present invention, a method of hands-free hanging a hand-operated tool is disclosed. The aforesaid method comprises steps of:

(a) providing a device comprising: (i) a drum retractor having a rotatable reel loaded by a spring; (ii) a cable having a first terminal secured to the reel and a second terminal connectable to the hand-operated tool; the cable is at least partially coiled on the rotatable reel; the cable is provided an arresting arrangement comprising a retaining member secured to the cable in cooperation with a quickly openable gate having an open position and a closed position such that the cable carrying the retaining member is uncoilable from the reel in the open position and blocked from uncoiling in the closed position; (b) providing a garment suitable to a user to be put on; (c) putting the garment on; (d) attaching the device to the garment; (e) connecting the second terminal to the hand-operated tool; (f) coiling and uncoiling the cable in the first position of the gate; and (g) blocking the cable from uncoiling in the closed position.

The invention claimed is:

1. A device for hands-free hanging a hand-operated tool; said device attachable to a garment; said device comprising:

a. a drum retractor having a rotatable reel loaded by a spring;

b. a cable having a first terminal secured to said rotatable reel and a second terminal connectable to said hand-operated tool; said cable is coilable on said rotatable reel;

said cable is provided with an arresting arrangement comprising a retaining member secured to said cable in cooperation with a quickly openable gate having an open position and a closed position such that said cable carrying said retaining member is uncoilable from said rotatable reel in said open position and blocked from uncoiling in said closed position, wherein said quickly openable gate comprises a cylindrical arrester rotatable around a longitudinal axis thereof; said cylindrical arrester has a side circumferentially-arranged recess of variable width; said circumferentially-arranged recess has a wider portion configured for passing said retaining member therethrough in said open position and a narrower portion configured for blocking said retaining member and passing said cable therethrough in said closed position.

2. The device according to claim 1, wherein said retaining member is a ball.

3. The device according to claim 1, wherein a position of said retaining member is adjustable along said cable.

4. A method of hands-free hanging a hand-operated tool; said method comprising steps of:

a. providing a device comprising:

i. drum retractor having a rotatable reel loaded by a spring;

ii. a cable having a first terminal secured to said rotatable reel and a second terminal connectable to said hand-operated tool; said cable is coilable on said rotatable reel;

wherein said cable is provided with an arresting arrangement comprising a retaining member secured to said cable in cooperation with a quickly openable gate having an open position and a closed position such that said cable carrying said retaining member is uncoilable from said rotatable reel in said open position and blocked from uncoiling in said closed position, said quickly openable gate comprises a cylindrical arrester rotatable around a longitudinal axis thereof; said cylindrical arrester has a side circumferentially-arranged recess of variable width; said circumferentially-arranged recess has a wider portion configured for passing said retaining member therethrough in said open position and a narrower portion configured for blocking said retaining member and passing said cable therethrough in said closed position;

b. providing a garment suitable to a user to be put on;

c. putting said garment on d. attaching said device to said garment;

e. connecting said second terminal to said hand-operated tool;

f. coiling and uncoiling said cable in said first position of said gate; and g. blocking said cable from uncoiling in said closed position.

* * * * *